United States Patent [19]

Carpenter et al.

[11] Patent Number: 4,771,718

[45] Date of Patent: Sep. 20, 1988

[54] CHIPPER DISC AND KNIFE ASSEMBLY

[75] Inventors: Charles T. Carpenter; Robert M. Bayly, both of Lake Oswego, Oreg.

[73] Assignee: Commercial Knife, Inc., Lake Oswego, Oreg.

[21] Appl. No.: 66,864

[22] Filed: Jun. 24, 1987

[51] Int. Cl.[4] ..... B02C 7/12

[52] U.S. Cl. ..... 144/176; 241/92; 241/298; 144/241

[58] Field of Search ..... 241/92, 298; 144/162 R, 144/176, 218, 241

[56] References Cited

U.S. PATENT DOCUMENTS

| | | | |
|---|---|---|---|
| 3,542,302 | 11/1970 | Salzmann, Jr. . | |
| 3,785,417 | 1/1974 | Vora . | |
| 3,981,337 | 9/1976 | Sundstrom . | |
| 4,047,670 | 9/1977 | Svensson . | |
| 4,503,093 | 3/1985 | Demopoulos | 144/241 |

*Primary Examiner*—W. Donald Bray

*Attorney, Agent, or Firm*—Kolisch, Hartwell & Dickinson

[57] ABSTRACT

Chipper apparatus including a rotating disc with one or more knives mounted on the disc operable to produce wood chips under the cutting action of the knives. Each knife comprises an elongate knife body bounded by opposed cutting edges. The knife includes a back side formed by back knife surfaces extending inwardly on the knife from its cutting edges and the back knife surfaces meeting with a bearing surface. The front side of the knife includes front knife surfaces extending inwardly on the knife from its cutting edges joining with an elongate key-receiving channel indented inwardly into the knife body. A knife is mounted on a rotatable chipper disc through a clamp member which bears against the bearing surface of a knife and a counter-knife which supports the front side of the knife and which includes an elongate key portion fitting within the key-receiving channel of the knife.

5 Claims, 1 Drawing Sheet

CHIPPER DISC AND KNIFE ASSEMBLY

BACKGROUND AND SUMMARY OF THE INVENTION

This invention relates to chipper apparatus, and more particularly, to chipper apparatus which includes a rotating chipper disc and one or more knives mounted on this disc operable to produce wood chips on the feeding of wood material against the chipper disc. Features of the invention include a novel construction for a double-edged chipper knife usable in such apparatus, and a novel mounting for a knife on a chipper disc.

In recent years, so-called double-edged chipper knives have become increasingly popular, since through turning of the knife a convenient way is provided for replacing the cutting edge which is used in the chipper without having to grind an edge. Furthermore, such knives lend themselves to use in a returnable system, wherein after dulling of both edges, they are returned or thrown away with the elimination of any grinding by the user.

While the advantages of double-edged knives are recognized, certain problems have been experienced with knife constructions known to date. Certain knives, for instance, have a geometry which is somewhat complex, introducing problems in making the knife and in properly mounting it on the chipper disc. A problem of general concern is that with many knife constructions, and during use, wood particles, resins, etc. tend to build up between the knife and the structure mounting it, causing displacement of the knife in its mounting and overheating of the knife. Furthermore, any system which relies upon clamping onto certain blade surfaces in a knife introduces a problem, in that should it be desired to change the angle of these blade surfaces, such also requires a change in the clamping structure which is used to clamp onto the knife in the chipper. Another problem which has been encountered is the tendency for a knife, when such twists in its mounting during use, to bend or break the mounting structure which clamps it in place on the chipper.

A general object of this invention is to provide an improved double-edged knife for a chipper with a construction taking care of many of the difficulties discussed above.

A more specific object is to provide a double-edged chipper knife which lends itself to being securely mounted in a chipper disc, but nevertheless, is devoid of the complex geometry characterizing certain prior art knives.

Another object is to provide a double-edged chipper knife which has a back side in part surfaced by blade surfaces, and in part surfaced by a bearing surface which is the surface utilized in clamping the knife in place. With the construction contemplated, any changes in the angles of the blade surface do not affect the placement or inclination of the bearing surface.

A further feature and object of the invention is a knife which features an elongate key-receiving channel on one of its sides relied upon to anchor the knife in place on the chipper disc, and organized in such a manner as to inhibit build up of wood residues between the knife and the structure mounting it.

Another object is to provide a novel mounting for a knife in a chipper disc assembly which results in minimal build up of wood residues between the knife and its mounting, a firm holding of the knife in a manner inhibiting twisting of the knife, and relatively easily performed replacement of parts subjected to abrasive wear during operation of the chipper.

These and other objects and advantages are obtained by the invention, which is described hereinbelow in conjunction with the accompanying drawings, wherein.

Figure 1:
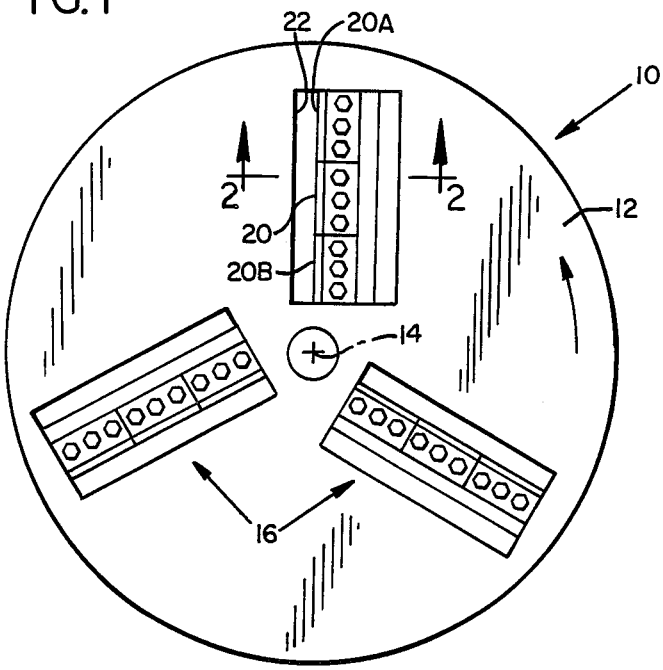
FIG. 1 is a view looking at the front of a chipper disc and illustrating knives and a mounting for these knives supporting the knives on the disc.

Referring now to the drawings, illustrated in FIG. 1 at 10 is a chipper disc which is substantially circular in outline, has a substantially flat disc surface 12 forming the face of the disc, and which is mounted in the chipper apparatus for powered rotation about its axis 14. Arranged with such extending generally radially on the chipper disc are multiple knife assemblies designated generally at 16. Although three such assemblies are shown, it should be obvious that the number and relative spacing of these knife assemblies are subject to variation with different sizes and types of chipper apparatus.

Each of the knife assemblies 16 is illustrated as having three knives disposed end to end and indicated at 20, 20A, and 20B, such being aligned with each other in the assembly. Again, it should be understood that the number of knives in a knife assembly will vary according to the individual installation.

During use, the chipper disc is rotated in the direction shown by the arrow in FIG. 1, or in a counter clockwise direction, which is the direction of travel of the disc. Immediately in advance of the knives in a knife assembly is an opening 22 provided in the disc. During operation of the chipper and with the advancing of a log or other wood against the chipper disc, the knives in a knife assembly shave wood chips from the wood, with such then traveling through an opening 22 to be expelled from the chipper.

Figure 3:
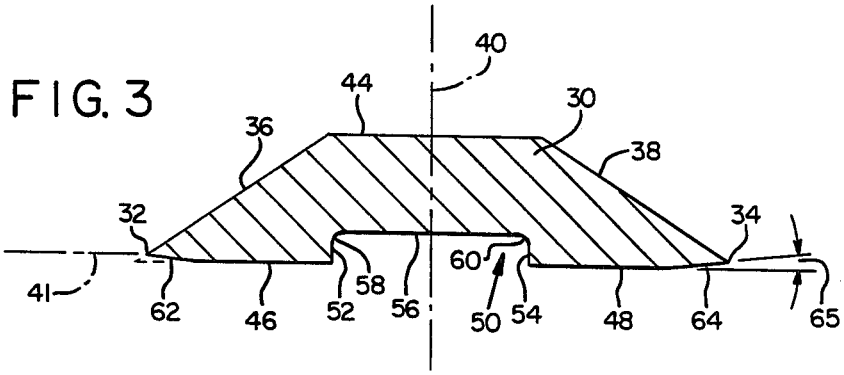
FIG. 3 is a cross-sectional view of a double-edged knife as contemplated, on an even larger scale.

Considering now in more detail the construction of a knife, and referring to FIG. 3 which illustrates the knife in cross section, such includes a knife body 30 bounded along opposite margins by elongate cutting edges indicated at 32 and 34. That part of the knife which appears at the top of FIG. 3 is referred to as the back side of the knife, and the opposite side or the side adjacent the bottom of FIG. 3, the front side of the knife.

The back side of the knife is defined by a pair of back knife surfaces 36, 38 extending inwardly on the knife body from respective cutting edges. These may have substantially equal widths and ordinarily are planar and are inclined at a common acute angle with respect to a plane, indicated at 40, which bisects the knife body and extends normal to the plane 41 defined by cutting edges 32, 34. In the particular embodiment of the invention illustrated, this angle is around 35 degrees, although the angle will vary depending on the chipper and the type of chips desired. Extending between and joining with these back knife surfaces is what is referred to as a bearing surface 44, which may be planar and ordinarily parallel to the plane of the two cutting edges. With the knife being symmetrical when viewed in a transverse cross section, plane 40 described bisects bearing surface 44.

The opposite or front side of the knife is defined by a pair of so-called front knife surfaces 46, 48, which in the embodiment of the invention shown are flat and occupy a common plane paralleling plane 41. Between these front knife surfaces and extending the length of the knife body is a key-receiving channel 50. Such is defined by side edges 52, 54 disposed normal to the plane of the knife edges, a floor 56 which generally parallels the plane of the knife edges, and preferably, rounds 58, 60 providing a smooth continuation between the side edges of the channel and its floor 56. With the knife body having symmetry in cross section, knife surfaces 46, 48 have equal width and key-receiving channel 50 is bisected by plane 40 earlier described.

In a preferred embodiment of the invention, the knife is relief ground at each of its opposite edges to provide adjacent these edges flat relief surfaces 62, 64. Each joins with a back knife surface in delineating an edge and extends to meet with a front knife surface. A relief surface inclines inwardly on the knife body from the plane of the front knife surfaces at a slight acute angle, typically, ranging from four to seven degrees (shown at 65 in FIG. 2).

Figure 2:
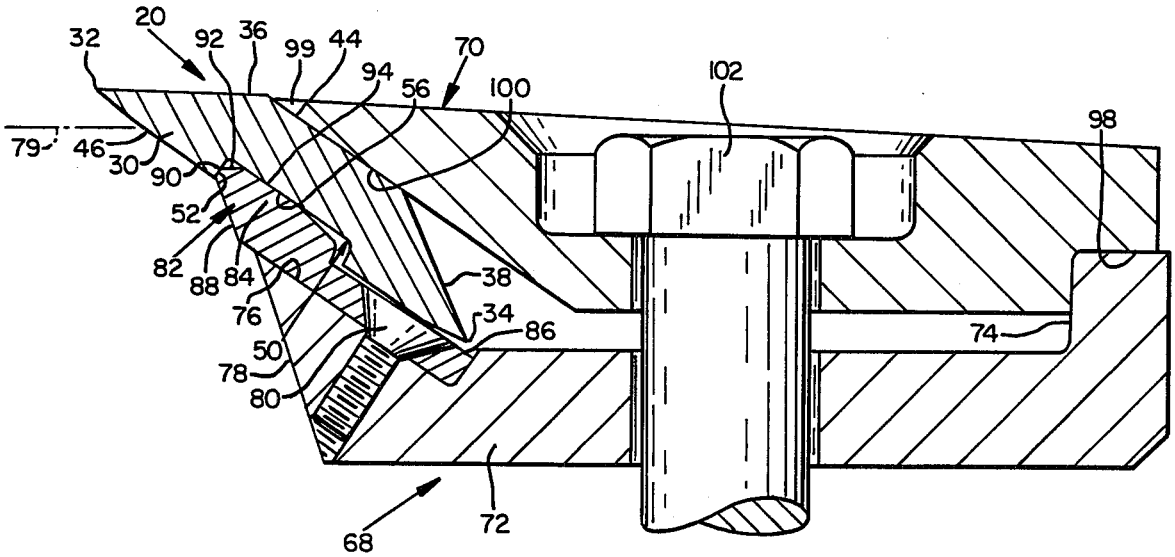
FIG. 2 is a an enlarged cross-sectional view, taken generally along the line 2—2 in FIG. 1, and showing further details of a knife as contemplated and its mounting on the chipper disc.

A knife of the type described is mounted in a knife assembly utilizing the mounting structure shown in FIG. 2. Specifically, this structure includes what is referred to as a base 68 and a clamp 70, these supporting a knife with the knife clamped therebetween.

Further describing the base, such includes a holder 72 provided along one edge with a ridge 74. The opposite edge of the holder is formed with an inclined shelf 76 and surfaced, where such faces the direction of travel of the knife assembly (which is to the left in FIG. 2), with a surface 78 which is inclined with respect to the plane of the disc surface which includes the knife assembly (shown at 79 in FIG. 2).

Detachably mounted on the holder as by screws 80 is a counter-knife or key element 82. Such extends the length of the knife and sits within shelf 76 of the holder. Formed along the forward margin of the counter-knife, which is its upper margin, as illustrated in FIG. 3, is an elongate key portion 84, and downwardly and to the right from this key portion a support surface 86. This key portion projects from the side of the counter-knife which faces the knife. Counter-knife 82 further includes an inclined wear or fender surface 88 extending along the underside thereof at its forward margin. Bounding the forward margin of key portion 84 is a forward edge or edge surface 90, and this edge joins with fender surface 88. Edge surface 90 joins through a round 92 with a surface 94.

Clamp 70 extends along the length of the knife above the knife. Such is notched along one edge by notch 98 which fits over ridge 74 of the holder. Along the underside of the clamp adjacent its opposite edge or toe 99 is a flat expanse referred to as a clamping surface 100. The clamp and holder are secured together and to the chipper disc by fasteners such as the one shown at 102. Reference may be had to U.S. Pat. No. 4,669,516 for further details of the mounting of such an assembly on a chipper disc.

With a knife mounted in place on a chipper disc utilizing the holder, counter-knife, and clamp illustrated in FIG. 2, the knife becomes positioned with one of its cutting edges (edge 32 in FIG. 2) positioned beyond the plane 79 of the cutter disc, and with this cutting edge and adjacent portions of the knife protruding over an opening 22 in the chipper disc. The knife is positioned with its front side facing the direction of travel of the disc, and with the plane of its front knife surfaces inclined at an acute angle with respect to the plane of the disc surface where such extends rearwardly from the cutting edge, or put in another way, where the plane recedes from the cutting edge. The knife is firmly clamped in position, with clamping surface 100 of the clamp clamped firmly against bearing surface 44 of the knife. Key portion 84 of the counter-knife seats within channel 50 provided on the front side of the knife. Edge surface 90 of the key portion bears against side edge 52 of channel 50. A forward portion of surface 94 of the key portion bears against a forward portion of floor 56 in the knife. The knife is additionally supported while in its clamped position with surface 86 bearing against the relief surface in the knife which is adjacent the cutting edge of the knife opposite edge 32, i.e., edge 34 in FIG. 2.

As so positioned, the knife is firmly held from twisting on itself, and forces tending to break or bend the clamp where such bears against the bearing surface of the knife are minimized. This is because when the exposed cutting edge of the knife meets resistance tending to cause it to twist in its mounting, such forces are resisted by toe 99 and adjacent surface portions of the clamp spaced a substantial distance from where the knife is supported adjacent its edge 34. Put in another way, the operative moment arm for the forces exerted on the protruding cutting edge in the knife is nearly the same as the operative moment arm for forces resisting turning, a feature not present in many prior art constructions.

It should also be noted that the knife surfaces on the back side of the knife are not used in clamping the knife in place. This means that the inclination of these back surfaces may be changed as desired to fit the particular operating conditions under which the chipper disc is used without affecting how the knife is held in place.

It should further be noted, and since edges 52, 54 defining channel 50 are normal or substantially normal to front knife surfaces 46, 48, there is minimal tendency for debris to work between the counter-knife and knife. The front side of the knife which extends from forward edge 32 inclines at an acute angle relative to the plain of the disc surface in a direction receding from this edge and meets with wear surface 88 in the counter-knife. This wear surface of the counter-knife also inclines at an acute angle relative to the plane of the disc surface in a direction receding from edge 32, this acute angle being somewhat greater than the first-mentioned acute angle. Thus material cut by the knife with operation of the chipper moves down along a front knife surface, i.e., surface 46 in FIG. 3, thence to travel over surface 88 of the counter-knife until finally deflected out of the chipper disc assembly. Material, if such is to work between the counter-knife and knife, must travel at substantially a right-angle path on leaving front knife surface 46.

During operation of the chipper, any wear which occurs on material moving past the exposed blade surface of the knife and thence over the counter-knife occurs for the most part in surface 88 of the counter-knife. If wear becomes excessive in this area, it is a relatively easy matter to replace the counter-knife to provide a new wear surface.

When one of the edges in a knife becomes dull through usage, the clamp mounting for the knife may be loosened and the knife removed. If the knife is then turned end-for-end and then remounted in the clamp mounting, this places its opposite edge in a cutting position. In its newly mounted position, the front side of the knife still faces forwardly and the back side rearwardly.

While there has been described herein a specific embodiment of the invention, obviously variations and modifications are possible without departing from the invention.

It is claimed and desired to secure by Letters Patent:

1. In chipper apparatus having a rotatably mounted chipper disc with the disc including a disc surface which is normal to the rotation axis of the disc, a chipper knife which comprises an elongate knife body bounded on opposite margins by elongate cutting edges, said knife body having a back side defined by a pair of back knife surfaces extending inwardly on the knife body from respective cutting edges and a bearing surface extending between and joining with the back knife surfaces, said knife body further having a front side defined by a pair of front knife surfaces extending inwardly on the knife from respective cutting edges and said front knife surfaces joining with an elongate, recessed key-receiving channel extending longitudinally on the knife, and a mounting for the knife on said disc supporting the knife with one of the knife's cutting edges disposed outwardly from said disc surface and the front side of the knife facing the direction of travel of the disc, said mounting comprising a clamp with has a clamping surface bearing against the bearing surface of said knife, and a base disposed opposite the front side of the knife, said base including an elongate raised key portion projecting from a side thereof which faces the knife and which fits within said channel, said key portion being bounded by a forward edge forming the forward margin of the base and said base including a wear surface facing the direction of travel of the knife which joins with the forward edge of the key portion, the front side of the knife which extends from said one edge of the knife meeting with said wear surface, the wear surface and front side of the knife both inclining at an acute angle relative to the plane of the disc surface extending in a direction receding from said one edge, and said base further including a portion which supports the front side of the knife adjacent the other edge of the knife.

2. The chipper apparatus of claim 1, wherein the cutting edges of said knife lie in substantially a common plane, and wherein said channel has side edges delineating side margins of the channel extending substantially normal to said plane, and said forward edge of the key portion bears against one of said side edges delineating a side margin of said channel.

3. The chipper apparatus of claim 1, wherein said base includes a holder and a counter-knife detachably mounted on said holder, said counter-knife having said key portion and said wear surface.

4. In chipper apparatus having a rotatably mounted chipper disc with the disc including a disc surface which is normal to the rotation axis of the disc, a chipper knife which comprises an elongate knife body having a front and back sides and elongate opposed edges bounding opposite margins of the knife, at least one of which is a cutting edge, said knife back side including an elongate bearing surface disposed intermediate said opposed edges, said knife body having an elongate key-receiving channel extending longitudinally of the knife body recessed inwardly form the front side of the knife, a mounting for the knife on said disc supporting the knife with said cutting edge disposed outwardly form said disc surface and the front side of the knife facing the direction of travel of the disc, said mounting comprising a clamp which has a clamping surface bearing against the bearing surface of said knife, and a base disposed opposite the front side of the knife, said base including an elongate raised key portion projecting from a side thereof which faces the knife and which fits within said channel, said key portion being bounded by a forward edge forming the forward margin of the base and said base including a wear surface facing the direction of travel of the knife which joins with the forward edge of the key portion, the front side of the knife which extends from said one edge meeting with said wear surface, said wear surface and the front side of the knife both inclining at an acute angle relative to the disc surface in a direction receding from said one edge of the knife, and said base further including a portion which supports the front side of the knife adjacent the other of said opposed edged of the knife.

5. The chipper apparatus of claim 4, wherein opposite margins of the knife lie in a common plane, and wherein said channel has side edges delineating side margins of the channel extending substantially normal to said plane, and said forward edge of the key portion bears against one of said side edges.

* * * * *